US006425353B1

(12) United States Patent
Davies

(10) Patent No.: US 6,425,353 B1
(45) Date of Patent: Jul. 30, 2002

(54) VEHICLE ENGINE COOLANT PUMP HOUSING

(75) Inventor: Richard David Davies, Port Melbourne (AU)

(73) Assignee: Davies Craig Pty Ltd., Port Melbourne (AU)

( * ) Notice: Subject to any disclaimer, the term of this patent is extended or adjusted under 35 U.S.C. 154(b) by 0 days.

(21) Appl. No.: 09/762,338

(22) PCT Filed: Nov. 23, 1999

(86) PCT No.: PCT/AU99/01042

§ 371 (c)(1),
(2), (4) Date: Feb. 5, 2001

(87) PCT Pub. No.: WO00/31388

PCT Pub. Date: Jun. 2, 2000

(30) Foreign Application Priority Data

Nov. 23, 1998 (AU) ..... 7241

(51) Int. Cl.[7] ..... F01P 5/12
(52) U.S. Cl. ..... 123/41.44
(58) Field of Search ..... 123/41.44

(56) References Cited

U.S. PATENT DOCUMENTS 4,434,749 A * 3/1984 Morita et al. ..... 123/41.44
4,557,223 A 12/1985 N Gueyen ..... 123/41.12
4,836,147 A 6/1989 Morris ..... 123/41.44
5,079,488 A * 1/1992 Harms et al. ..... 123/41.44
5,785,013 A * 7/1998 Sinn et al. ..... 123/41.44

FOREIGN PATENT DOCUMENTS

| | | |
|---|---|---|
| DE | 26 56 361 | 6/1978 |
| DE | 41 23 661 | 6/1993 |
| FR | 2 384 106 | 10/1978 |
| FR | 2 699 960 | 7/1994 |
| FR | 2 752 016 | 9/1998 |

* cited by examiner

*Primary Examiner*—Gene Mancene
*Assistant Examiner*—Hyder Ali
(74) *Attorney, Agent, or Firm*—Baker & Daniels

(57) ABSTRACT

A coolant system for a vehicle engine which may retrofitted if desired, the coolant system including a coolant flow circuit which in part includes passage means through an engine block of the vehicle engine and through a heat exchanger. The coolant system further includes a coolant pump which, when operated, causes coolant flow around the coolant flow circuit, the coolant pump being driven by an electric motor independently of the vehicle engine. The coolant system still further includes a coolant temperature sensor and controller means whereby pulsed voltage levels are supplied to the motor in response to differing coolant temperature levels being sensed by the coolant temperature sensor.

26 Claims, 1 Drawing Sheet

VEHICLE ENGINE COOLANT PUMP HOUSING

The present invention relates to improvements in cooling arrangements for vehicle engines and stationary engines.

Currently vehicle engines are cooled by pumping a liquid coolant around the engine block to pick up heat therefrom and to dissipate such heat from the coolant by passing same through a heat exchanger or radiator. Typically a mechanically driven coolant pump is provided which may be connected to or form part of the engine block and be driven directly from the engine itself by way of a belt and pulley drive. That is, when the engine is not operating the pump also is stationary and no coolant flow occurs other than by thermal syphoning effects. Conversely, when the engine is operating, the speed of rotation of the pump is directly related to the rotational speed of the engine. As a consequence of this, the volume flow rate of the coolant is also directly related to the rotational speed of the engine. This conventional arrangement is believed to have a number of disadvantages in practice including that while the engine is operating large volumes of coolant may be circulated by the pump even though the cooling requirements of the engine may not require same or cavitation may occur at high speeds restricting coolant flow. This also causes an energy drain on the engine and therefore a lack of engine efficiency. Also when the vehicle is stationary and idling, the engine speed is low providing a low coolant flow rate but a high flow rate at times is required. Similarly, each time gearing is changed (either manually or via an automatic transmission), there is instantly an inertia problem for the pump to vary the liquid flow rate immediately to accord with the changed engine speed. Finally, with modern vehicle engine design, there is a practical problem in that many accessories or moving parts of the engine are directly driven via a serpentine drive belt and associated pulleys from the engine drive shaft with the coolant liquid pump being one of these items. If the coolant pump did not have to be driven in this way, then it would, to some extent simplify the design of the drive for the other parts or devices. In addition, when a hot engine is turned off, the coolant continues to absorb heat from the engine block, which heat is slow to dissipate and which allows very high load temperatures, sometimes causing damage or needless wear.

The objective therefore of the present invention is to provide a novel coolant system for a vehicle engine that will overcome or minimise some or all of the aforementioned difficulties associated with the current mechanical drive arrangements.

Accordingly, the present invention provides a coolant system for a vehicle engine, said coolant system including a coolant flow circuit which in part includes passage means through an engine block of an internal combustion engine and through a heat exchanger, said coolant system further including a coolant pump means adapted, when operated, to cause coolant flow around said coolant flow circuit, said coolant pump means being driven by drive means independent from said engine. Conveniently said drive means may be an electric motor which may be either a single speed motor or a dual or variable speed motor. The drive means may be itself operated, to thereby drive the pump means, continuously while the engine is operated, or alternatively, the drive means may be thermally controlled in response to engine temperature whereby the pump means operates only when engine cooling is required. The pump means is preferably mounted in the lower heat exchanger (radiator) hose leading from the radiator to the engine block. It is, however, possible to locate the pump means in a number of different locations including the top radiator hose (leading from the engine block to the radiator), as part of the radiator either adjacent its inlet or its outlet, or connected to or as part of the engine block.

In accordance with a further aspect, the present invention provides a coolant system for an internal combustion engine, said coolant system including a coolant flow circuit for a coolant which in part includes passage means for the coolant through an engine block of the engine and through a heat exchanger, said coolant system further including a coolant pump means adapted, when operated, to cause coolant flow around said coolant flow circuit, said coolant pump means being driven by an electric motor independently of said engine, and a coolant temperature sensor means and controller means to control coolant flow delivery output from said coolant pump in response to differing coolant temperature levels being sensed by said coolant temperature sensor means, said controller means being arranged to vary the speed of the electric motor by pulsing the voltage level supplied thereto, the voltage level being pulsed for at least a period of operation of the engine for a period "on" and a period "off" wherein the period "on" is at least one second, with a percentage of the voltage "on" relative to the voltage "off" increasing in response to the coolant temperature level increasing as sensed by said coolant temperature sensor means. In this way, the speed of the electric motor is varied in response to said differing coolant temperature levels being sensed by said coolant temperature sensor means and as a result the flow rate of coolant is similarly varied.

In one embodiment, the controller means enables differing voltage levels to be supplied to said motor in response to differing coolant temperature levels being sensed by said coolant temperature sensor means.

In one embodiment, the voltage level is pulsed for a period on and a period off, with the percentage of voltage on or the magnitude of the voltage on relative to voltage off periods increasing in response to sensed temperature level increases. Similarly the percentage of voltage on or the magnitude of the voltage on relative to the voltage off period may decrease in response to sensed temperature level decreases. Alternatively, a microprocessor may be used for infinitely varying voltage, on the size of pulsed voltage, in response to sensed temperature levels. In another embodiment, the voltage level is simply stepped from a minimum viable level to a maximum level in response to increased coolant sensed temperature levels. In a still further embodiment, a combination of the aforesaid pulsing of voltage and stepped increase of voltage levels might be used. Of course, voltage levels or the relative degree/percentage of voltage pulsing on to off will decrease in response to decreases in coolant sensed temperature levels.

Further preferred features and aspects of the present invention may be seen from the annexed patent claims which are hereby made part of this specification.

Various aspects of the present invention will be more readily understood from the following description given in relation to the accompanying drawings, in which.

Figure 1:
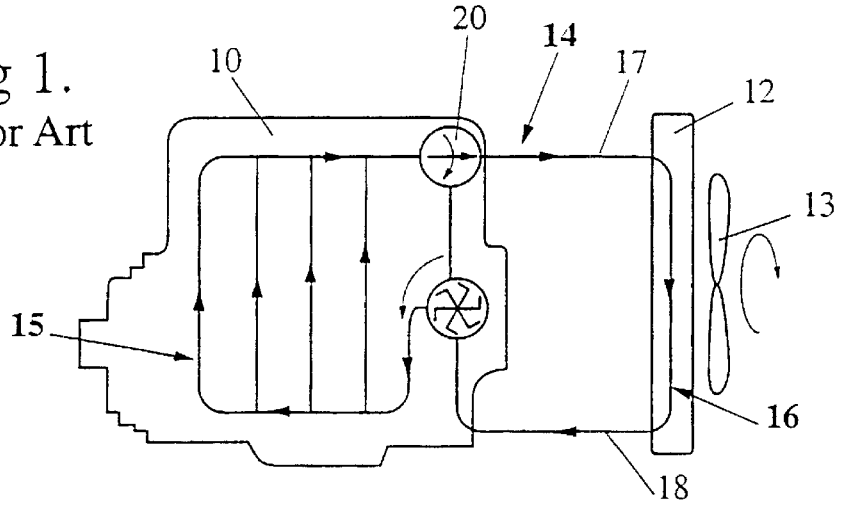
Fig 1. Prior Art
FIG. 1 illustrates schematically a typical prior art vehicle engine cooling configuration.

Referring to FIG. 1 of the annexed drawings, the conventional arrangement comprises a vehicle engine block 10 and radiator or heat exchanger 12 with its associated fan 13.

A coolant flow circuit 14 is shown which has a first part 15 located within the engine block 10, a second part 16 located within the radiator 12 and upper and lower hose connections 17, 18. A coolant impeller pump 19 is provided and driven mechanically by a belt and pulley drive (not shown) from the engine drive shaft. A thermostatically controlled valve 20 directs coolant either to the radiator via hose 17 or to the pump 19 via passage 21 depending on the temperature of the engine block. That is, when the engine is cold, the coolant is circulated via passage 21 and the engine block part of the coolant flow circuit 15 until the engine temperature reaches a predetermined level and thereafter coolant flow is established through the radiator 12. In this arrangement, there is no coolant flow while the engine is not operating, and while the engine is operating, coolant flow volumes are related to engine rotational speed.

Figure 2:
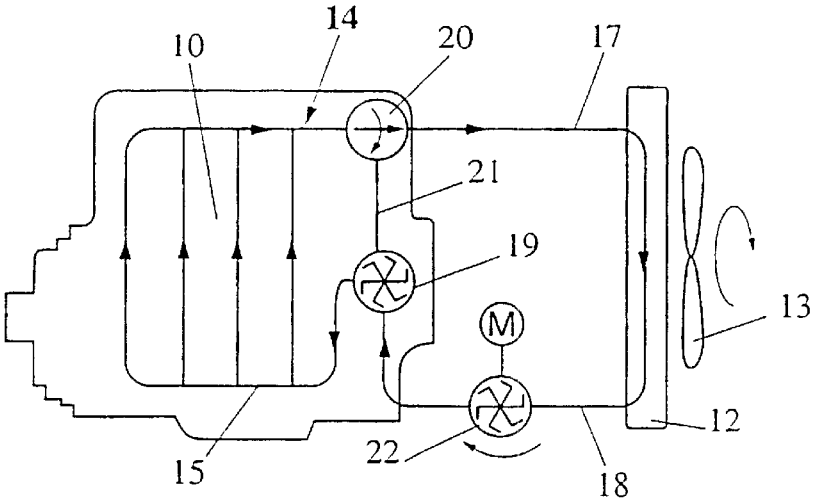
FIG. 2 illustrates schematically a first preferred embodiment according to this invention.

FIG. 2 illustrates a modification to the conventional system shown in FIG. 1 in accordance with the present invention. In this arrangement, it is proposed to retrofit an existing arrangement with a coolant flow device according to the present invention although it may be possible to have a similar arrangement as original equipment. In this system a pump device 22, driven conveniently by a separate electric motor M, is installed in the lower radiator hose 18. It will of course be apparent that the device 22 could also be installed in the upper hose 17 but with the arrangement illustrated, cavitation in the pump is likely to be avoided. With this retrofitted arrangement, the impeller of the existing pump 19 is simply removed and its shaft is then freely rotatable and does not act as a pump and further any drag is minimised. The pump 22 may be arranged to operate substantially continuously while the ignition is turned on, or alternatively, it may be turned on and off depending upon thermal requirements, for example in response to a temperature sensor sensing engine block temperatures. At start up of the engine, coolant may be allowed to circulate through the circuit 14 including the radiator by providing a small hole (restricted flow passage) in the thermostatically controlled valve 20 at a very low rate until the valve itself opens upon the engine heating to the required temperature level or alternatively the thermostat may be removed.

Figure 3:
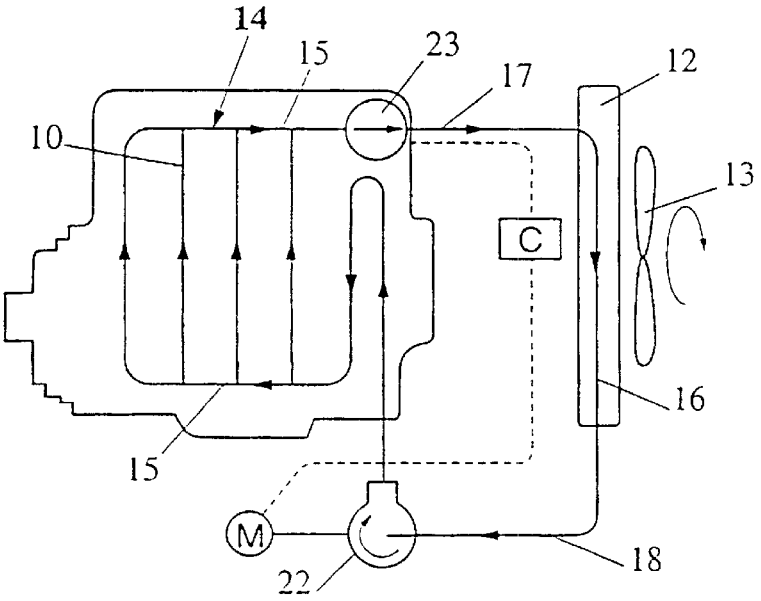
FIG. 3 illustrates schematically a second preferred embodiment according to this invention.

FIG. 3 illustrates a still further possible arrangement which may be retrofitted to an existing system, or may be formed as original equipment. The pumping device 22 driven by an independent drive means such as an electric motor M may be, as illustrated, located in the lower hose 18. Alternatively, it may be located in the upper hose 17, in the radiator 12, at the inlet/outlet to the radiator 12, or as part of the engine block 10. In one possible arrangement, the independent electric motor may be connected to the existing pump device 19 in the engine block if the pump device 19 is adapted to provide suitable coolant flow rates. Conveniently, the motor M may, in one embodiment, be turned on or off by a temperature switch 23 sensing engine block temperature.

In a still further preferred embodiment, the electric motor M might be drivable at variable speeds in response to voltage levels applied to the motor M. Thus when the temperature sensor 23 in this case senses coolant temperatures less than a predetermined minimum, the motor M is not operated. When the predetermined minimum temperature is sensed, a controller device C activates the motor M at a minimum voltage level sufficient to operate the motor M to drive the pump 22. The minimum temperature level may, for example, be about 80° C. and in one preferred arrangement the minimum voltage level may be between 1.4 and 2.1 volts. At increased temperature levels, the controller device C progressively increases the voltage level applied to the motor M in response to increases in sensed temperature increases associated with the coolant via the coolant temperature sensor 23.

Increases in applied voltage levels to the motor M will increase the speed of the motor and therefore the pump 22 thereby increasing coolant flow rates. Conversely, should the coolant sensed temperature drop progressively, then the voltage level applied to the motor M determined by the controller C will also drop. The aforesaid increases and decreases may conveniently occur in a step wise manner. In one preferred arrangement, up to a minimum coolant temperature (about 80° C.), the pump 22 does not run at all. In another arrangement the pump may run continuously and up to a predetermined coolant temperature (say about 80° C.), the pump 22 may run at a minimum speed, increasing therefrom on sensing increased coolant temperatures. Between the aforesaid minimum coolant temperature and an intermediate temperature, say about 90° C., the motor M is pulsed at the minimum voltage (for example 2.10 Volts) for a certain period on and a certain period off (for example 2 seconds on and 5 second off). From the intermediate sensed temperature up to a maximum temperature (about 100° C.), the controller C constantly arranges the supply of voltage to the motor M which is increased in preset voltage stages in response to sensed temperature levels from the minimum voltage level (for example 2.1 Volts) up to the maximum voltage level (12 Volts) when the temperature sensed is 100° C. or higher.

With an arrangement as illustrated and as described herein, it is possible to have the pump run on for a short period after the engine itself stops running which may be beneficial in some applications. With such arrangements, it is also possible to have the coolant pump controlled by a vehicle management computer that may or may not control the thermostatically controlled coolant valve and the electric fan for the radiator. For example, at a preset temperature level (e.g. about 98° C.) the electric fan 13 may be activated to boost the cooling capacity of the system.

The claims defining the invention are as follows:

1. A coolant system for an internal combustion engine, said coolant system including a coolant flow circuit for a coolant which in part includes passage means for the coolant through an engine block of the engine and through a heat exchanger, said coolant system further including a coolant pump means adapted, when operated, to cause coolant flow around said coolant flow circuit, said coolant pump means being driven by an electric motor independently of said engine, and a coolant temperature sensor means and controller means to control coolant flow delivery output from said coolant pump in response to differing coolant temperature levels being sensed by said coolant temperature sensor means, wherein said controller means is arranged to vary the speed of said electric motor by pulsing the voltage level supplied thereto, the voltage level being pulsed for at least a period of operation of the engine for a period "on" and a period "off", with a percentage of the voltage "on" relative to the voltage "off" increasing in response to the coolant temperature level increasing as sensed by said coolant temperature sensor means, and wherein said controller means enables differing voltage levels to be supplied to said motor in response to differing coolant temperature levels being sensed by said coolant temperature sensor means.

2. A coolant system according to claim 1 wherein the electric motor is a dual speed motor.

3. A coolant system according to claim 2 wherein the pump means is located in a lower heat exchanger hose leading from the heat exchanger to the engine block.

4. A coolant system according to claim 1 wherein the electric motor is a variable speed motor.

5. A coolant system according to claim 4 wherein the pump means is located in a lower heat exchanger hose leading from the heat exchanger to the engine block.

6. A coolant system according to claim 1 wherein the pump means is located in a lower heat exchanger hose leading from the heat exchanger to the engine block.

7. A coolant system according to claim 1, wherein the voltage levels supplied to the electric motor is stepped between two levels being a minimum viable voltage level and a maximum voltage level, in response to the sensed coolant temperature level increasing beyond a first predetermined level as sensed by the coolant temperature sensor means.

8. A coolant system according to claim 7, wherein the voltage level supplied to the electric motor is stepped from said maximum voltage level to said minimum viable voltage level in response to the sensed coolant temperature level decreasing beyond a second predetermined level as sensed by the coolant temperature sensor means.

9. A coolant system according to claim 7, wherein the voltage level supplied to the electric motor includes at least one intermediate voltage level between said minimum viable voltage level and said maximum voltage level.

10. A coolant system according to claim 7, wherein at any said voltage level, the voltage level is pulsed "on" or "off" with the ratio of "on" to "off" increasing in response to the sensed coolant temperature level increasing as sensed by said temperature sensor means.

11. A coolant system according to claim 1, wherein the coolant temperature sensor means is arranged to sense the coolant temperature either as it leaves the engine block or between the engine block and the heat exchanger.

12. A coolant system according to claim 1, wherein the period "on" is at least one second.

13. An arrangement for retrofitting to an internal combustion engine including a coolant pump means, an electric motor for driving said coolant pump means, a controller means, a coolant temperature sensor means, and connection means for connecting the coolant pump means and the coolant temperature sensor means into a coolant flow circuit of the engine, wherein said controller means is arranged to vary the speed of said electric motor by pulsing the voltage level supplied thereto, the voltage level supplied to the electric motor being pulsed for at least a period of operation of the engine for a period "on" and a period "off", with a percentage of the voltage "on" relative to the voltage "off" increasing in response to the coolant temperature level increasing as sensed by said coolant temperature sensor means, and wherein said controller means enables differing voltage levels to be supplied to said electric motor in response to differing coolant temperature levels being sensed by said coolant temperature sensor means.

14. An arrangement according to claim 13, wherein the period "on" is at least one second.

15. An arrangement according to claim 13 wherein the controller means is arranged to supply the voltage to the electric motor as follows:

when the sensed coolant temperature is below a first predetermined temperature, the voltage is off;

when the sensed coolant temperature is between the first predetermined temperature and a second predetermined temperature, the voltage is pulsed at an intermediate voltage level which is less than a maximum voltage level; and when the sensed coolant temperature is above the second predetermined temperature, the magnitude of the voltage is increased from the intermediate voltage level to the maximum voltage level in response to the coolant temperature increasing beyond the second predetermined temperature.

16. An arrangement according to claim 15, wherein the period "on" is about two seconds and the period "off" is about 5 seconds.

17. A method of cooling an internal combustion engine having a coolant flow circuit and a coolant pump adapted, when operated, to cause coolant flow around said coolant flow circuit, said coolant pump being driven by an electric motor independently of said engine, the method including the steps of:

providing a coolant temperature sensor for sensing the temperature of said coolant;

controlling the speed of said electric motor by pulsing the voltage level supplied thereto, the voltage level being pulsed for at least a period of operation of the engine for a period "on" and a period "off", with a percentage of the voltage "on" relative to the voltage "off" increasing in response to the coolant temperature level increasing as sensed by said coolant temperature sensor; and supplying differing voltage levels to said motor in response to differing coolant temperature levels being sensed by said coolant temperature sensor.

18. A method according to claim 17, including the step of:

stepping the voltage level supplied to said motor between two levels being a minimum viable voltage level and a maximum voltage level, in response to the sensed coolant temperature level increasing beyond a first predetermined level as sensed by the coolant temperature sensor.

19. A method according to claim 18 including the step of:

stepping the voltage level supplied to said motor from said maximum level to said minimum viable voltage level in response to the sensed coolant temperature level decreasing beyond a second predetermined level as sensed by the coolant temperature sensor.

20. A method according to claim 19, wherein the voltage level supplied to the electric motor includes at least one intermediate voltage level between said minimum viable voltage level and said maximum voltage level.

21. A method according to claim 18, wherein the voltage level supplied to the electric motor includes at least one intermediate voltage level between said minimum viable voltage level and said maximum voltage level.

22. A method according to claim 17, wherein the period "on" is at least one second.

23. A coolant system according to claim 1 wherein the controller means is arranged to supply the voltage to the electric motor as follows:

when the sensed coolant temperature is below a first predetermined temperature, the voltage is off;

when the sensed coolant temperature is between the first predetermined temperature and a second predetermined temperature, the voltage is pulsed at an intermediate voltage level which is less than a maximum voltage level; and when the sensed coolant temperature is above the second predetermined temperature the magnitude of the voltage is increased from the intermediate voltage level to the maximum voltage level in response to the coolant temperature increasing beyond the second predetermined temperature.

24. A coolant system according to claim 23 wherein the period "on" is about 2 seconds and the period "off" is about 5 seconds.

25. A method according to claim 17 further including the steps of:

when the sensed coolant temperature is below a first predetermined temperature, turning off the supply voltage to the motor;

when the sensed coolant temperature is between the first predetermined temperature and a second predetermined temperature, pulsing the voltage supplied to the motor at an intermediate voltage level which is less than a maximum voltage level; and when the sensed coolant temperature is above the second predetermined temperature, increasing the magnitude of the voltage supplied to the motor from the intermediate voltage level to the maximum voltage level in response to the coolant temperature increasing beyond the second predetermined temperature.

26. A method according to claim 25 wherein the period "on" is about 2 seconds and the period "off" is about 5 seconds.

* * * * *